US006709083B2

(12) United States Patent
Fukushima

(10) Patent No.: US 6,709,083 B2
(45) Date of Patent: Mar. 23, 2004

(54) PRINT CONTROL DEVICE AND METHOD OF PRINTING USING THE DEVICE

(75) Inventor: Itaru Fukushima, Tokyo (JP)

(73) Assignee: Cyber Graphics Corporation, Tokyo (JP)

( * ) Notice: Subject to any disclaimer, the term of this patent is extended or adjusted under 35 U.S.C. 154(b) by 89 days.

(21) Appl. No.: 10/042,521

(22) Filed: Jan. 9, 2002

(65) Prior Publication Data

US 2002/0113833 A1 Aug. 22, 2002

(30) Foreign Application Priority Data

Jan. 12, 2001 (JP) ..... 2001-004471

(51) Int. Cl.[7] ..... B41J 29/38; B41J 2/35

(52) U.S. Cl. ..... 347/17; 347/211

(58) Field of Search ..... 347/17, 19, 211, 347/14, 183, 62, 195, 196, 188–192, 194, 171; 400/120.01, 120.09, 120.1, 54, 120.11, 120.14; 503/217

(56) References Cited

U.S. PATENT DOCUMENTS 4,399,188 A * 8/1983 Yamato et al. ..... 503/217
4,725,858 A * 2/1988 Bond ..... 346/136

FOREIGN PATENT DOCUMENTS

JP 61123566 A * 6/1986 ..... B41J/29/46
JP 401011853 A * 1/1989 ..... B41J/3/20
JP 6-198943 7/1994

* cited by examiner

*Primary Examiner*—Lamson Nguyen
*Assistant Examiner*—K. Feggins
(74) *Attorney, Agent, or Firm*—Flynn, Thiel, Boutell & Tanis, P.C.

(57) ABSTRACT

A print control device and method utilizes a thermal head provided with a set of minute heating members serving as both a heating element and a temperature detector and a drive circuit for supplying an electric current to drive the heating members; a control circuit for switching the electric current flowing to the respective heating members between a heating drive state and a temperature detection state; a circuit for converting temperature values from each of the heating members to voltage values and for detecting the voltage values using electrical current that flows during the temperature detection state; an analog/digital conversion circuit for converting the voltage into a digital value; an adder for cumulatively adding digital values obtained by the digital conversion from the start of heating; a comparator for comparing the cumulative value obtained by the adder against a target print density value set in advance with respect to a given point on which printing is to be executed and sent from a superior device, to thereby determine which one is greater; and a circuit for stopping the heating drive of the heating member if the comparator detects that the target print density has been reached.

6 Claims, 4 Drawing Sheets

PRINT CONTROL DEVICE AND METHOD OF PRINTING USING THE DEVICE

TECHNICAL FIELD

The present invention relates to a print control device and method for controlling the heat energy supplied to a thermal head of a printer apparatus that develops color on a medium in gradations according to the amount of thermal energy applied, or executes printing by image transfer using fusion transfer of an intervening thermal-transfer film or a sublimation transfer thereof.

PRIOR ART

Conventionally, as a method for controlling the heat energy to be applied onto a thermo-sensitive recording medium, it was common to use a method generally called "heat history control", in which the temperature of fixed-resistance heating elements on a thermal head was estimated based on past print history information to thereby control the amount of heat energy to be generated by the fixed-resistance elements on the thermal head.

This method is performed by making an estimation, therefore, since different heat emission conditions apply between printing executed in a cold region and that in a tropical region, and since the temperature on the surface of the paper medium also varies accordingly, there was a problem that control errors were easily generated. Accordingly, since the control was performed according to a calculation based on an estimation, it was difficult to achieve a high precision and stable print control.

There is another method in which an alloy such as Cr or Al or the like, which is a material that changes its resistance value depending on its temperature, is used as a heating element to construct the thermal head, and during the printing its temperature is measured so that the print history is not relied upon in order to perform the print control. However, even in this method the object of control is not the value of the heat energy generated by the heating member. Rather, the control is performed using the detected temperature data, so there was a problem that the color development density to be realized on the thermal recording medium could not be controlled accurately.

Further, it was also necessary to deal with an error in the print density caused because, as reflected in the fact that the color development characteristic of thermo-sensitive recording medium is called y-property, there is no linear proportional relationship between the supplied heat energy and the color development density.

Additionally, there was a problem that it was impossible to detect overheating of the thermal head even when damage was likely to occur as a result, which affected the reliability of the print control. For example, if heating control was executed in a state when the thermal head was not in contact with the surface of the paper medium, the temperature of the heating members of the thermal head rose to an abnormally high level and therefore the heating members became burnt and damaged.

SUMMARY OF THE INVENTION

An object of the present invention is to solve the above problems inherent in the conventional devices and methods and to provide a print control device and method capable of high precision and stable print control.

That is, according to the present invention, there is provided a print control device comprising: a thermal head provided with a set of minute heating members, each serving as both a heating element and a temperature detector, and a drive circuit for supplying an electric current to drive said heating members; a control circuit for effecting switching of the electric current flowing to the respective heating members between a heating drive state and a temperature detection state; a circuit for converting temperature values from each of the heating members to voltage values and for detecting the voltage values, using electrical current that flows during the temperature detection state; an analog/digital conversion circuit for converting said voltage into a digital value; an adder for cumulatively adding digital values obtained by the digital conversion from the start of heating; a comparator for comparing the cumulative value obtained by said adder against a target print density value which is set in advance with respect to a given point on which printing is to be executed and sent from a superior device, to thereby determine which one is greater; and a circuit for stopping the heating drive of said heating member if the comparator detects that the target print density has been reached.

Further, according to the present invention, in order to perform appropriate heating control with respect to the color developing medium to thereby obtain print images of excellent image quality, the temperatures of heat generated by each of the heating elements in the heated thermal head are measured and the generated thermal energy is calculated again and again at constant time intervals, producing the result that the intended color development density is achieved at each of the color developing points of the color developing medium.

Another aspect of the present invention is directed to a method of printing comprising the steps of: providing a print control device comprising a thermal head having a set of minute heating members, each heating member serving as both a heating element and a temperature detector, and a drive circuit; supplying an electric current to drive the heating members; switching the electric current supplied to the heating members between a heating drive state and a temperature detection state; converting temperature values from each of the heating members to a voltage value; determining the voltage value based on the electric current flowing during the temperature detection state; converting the voltage value into a digital value; adding the digital values to obtain a cumulative value; comparing the cumulative value with a target print density value to determine which value is the greatest; and interrupting the supply of electric current to the heating members if the target print density has been reached.

DESCRIPTION OF REFERENCE NUMERALS

Figure 1:
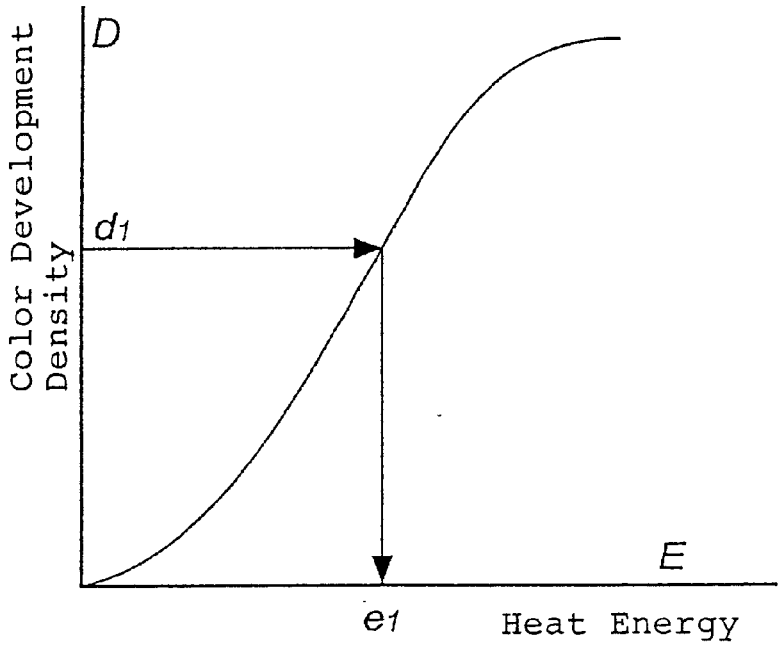
FIG. 1 is a characteristic chart showing a relationship between thermal energy applied to ordinary thermo-sensitive recording paper and color development density.

100 minute heating member
101 data register
102 input terminal
109 inverter
111 linear amplifier circuit
112 analog/digital converter
113 adder
117 greatness comparing circuit
120 drive transistor

DETAILED DESCRIPTION OF THE INVENTION

Hereinafter, detailed explanation will be made of the present invention. Examples of devices in which the present invention may be applied include a fusion thermal transfer-type printer and sublimation-type thermal transfer printer. However, a thermal printer using a so-called thermal recording medium could be used in addition to these devices.

An example of usage of the thermal printer using the thermo-sensitive recording medium will be described.

Description will also be made regarding an example of usage of a thermal head having a construction in which minute heating members are arranged in an array in a concentration of 200 or 300 dots per inch, for example.

When printing is performed by this thermal head, in the case when the concentration of dots is 200 dots/inch, the head moves across the medium at a pitch of 1/200th of an inch while performing the printing.

Hereinafter, explanation will be made of a heat control operation for one pitch when the print operation is executed for each one pitch at a time. The present invention is different from the conventional print control method called history control method, in that in the print control for one print pitch, it is not at all necessary to be concerned with the heating control of those pitches on which printing has already been executed, and only the temperature of the thermal head as measured each time when printing is executed for each individual pitch is used to effect the print control.

That is, in the present invention the control is always performed independently for each pitch, regardless of the past history.

For the thermo-sensitive recording medium in the embodiment, a color developing medium is used such as a so-called monochrome thermo-sensitive recording paper, or two-color thermo-sensitive recording paper or Thermo Autochrome paper, generally called TA medium, produced and sold by Fuji Film, for example.

As regards the color development characteristics of each color in any of these thermo-sensitive recording media, as shown in FIG. 1 for example, D: the color development density upon printing is determined by E: the thermal energy applied by heating elements on the thermal head. Such characteristic charts are publicized by each of the thermal recording paper manufacturers with respect to each type of thermal recording paper.

Note that it should be remembered here that the horizontal axis in the characteristic chart represents the value of the heat generated at the thermal head, which is the value of the heat energy supplied onto the medium. As such, it does not represent the temperature value. Therefore, in order to achieve a desired color development density "d1" on a given minute color developing point on the medium in FIG. 1, it is sufficient to perform a control such that the thermal energy generated by the corresponding minute heating element on the thermal head becomes equal to "e1". However, in the case of the thermal head that was mentioned in the section of the Prior Art which used the fixed-resistance heating member, the amount of the generated heat energy was ultimately "estimated" by means of a calculation based on the print history obtained on a basis of the past printing results. Therefore, when several sheets of the media were printed in succession, for example, the thermal head accumulates heat and its temperature rose. Thus, as the number of printed sheets increased, the color development density on the paper surface also increased unfavorably. This problem is rooted in that an error is produced since the estimation calculation is used to determine the current temperature of the thermal head itself, on the basis of the heat energy e1 that needs to be generated to obtain the density d1 above is determined. In other words, in the conventional method the temperature of the heating member before it was heated was not clear, and so when determining the heating amount of the heating member on a basis of an estimation, an error was produced when the estimated temperature did not accurately reflect the actual temperature.

Further, as mentioned above in the Prior Art, a method has appeared in recent years in which there is used a thermal head employing as a heating element thereof a material whose resistance value changes in accordance with the temperature of the heat generated, and the temperature thereof is measured while printing is being performed, to thereby effect the print control without relying on the print history.

This method, in which control is effected by temperature measurement, is a method in which as the heating member produces heat and its temperature rises as a result, that temperature t1 is measured, whereby the control of color development density becomes possible by assuming that this t1 is proportional to the print density d1. However, an error is produced with this method because when the actual printing is taking place the temperature changes again and again with the passing of time and thus differs from the initial temperature.

Figure 2:
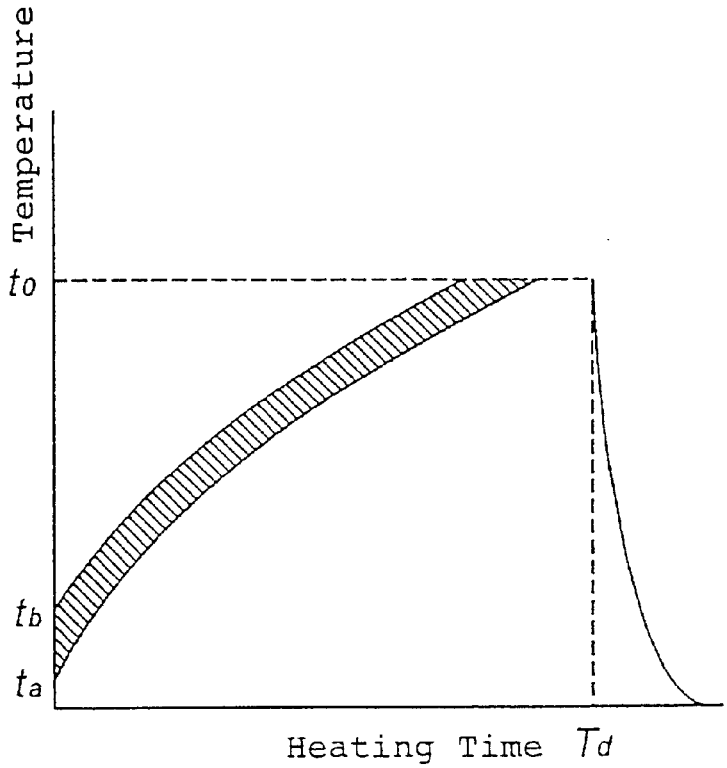
FIG. 2 is a chart for explaining that a difference in the applied energy develops when thermal color development is started at different initial temperatures, provided that heating operation control is performed for the same duration of time.

In other words, where in FIG. 2 the vertical axis represents temperature and the horizontal axis represents time, and the relationship between the temperature increase of the minute heating members of the thermal head upon heating and the passage of time is examined, when comparison is made between a case in which the initial temperature of "ta" increases and reaches the target control temperature "to" and the driving is stopped at the time "Td", and another case in which the temperature "tb" is increased to the target control temperature "to" and the driving is stopped at "Td", the amount of heat generated is greater when heating is started from the temperature tb, by an amount proportionate to the hatched portion. This is the cause which produces the error.

That is, the total of the temperature change (ta−tb) corresponding to each time change TD is the error E. In other words, the amount of energy expressed as E=KÓ (ta−tb)·Td is the error. Here, K is a proportional constant including a specific heat capacity q described later.

The above is confirmed in the actual printing, and it is confirmed that there is a difference in the degree of print density between the two cases.

Operation

Figure 3:
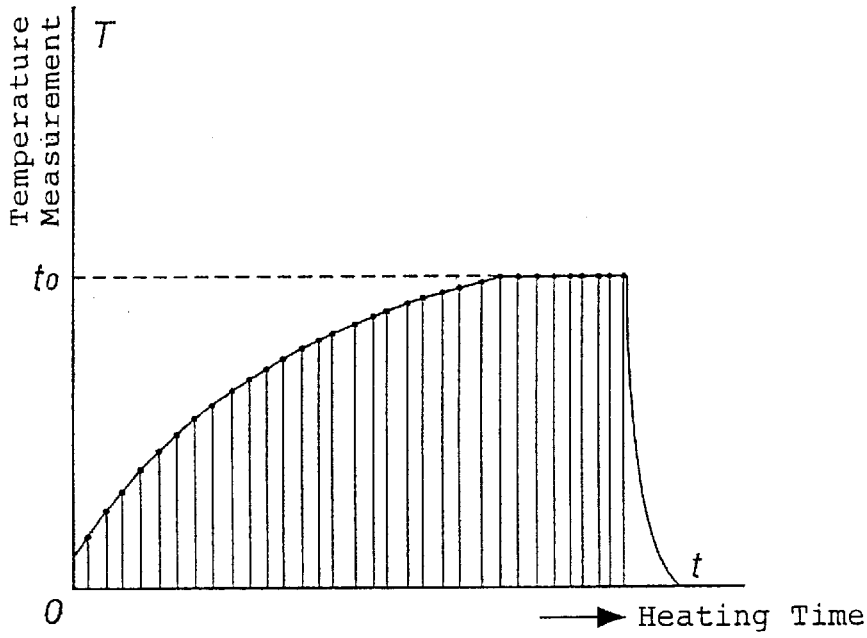
FIG. 3 is a chart for explaining a method in which a temperature of a heating member is repeatedly measured and cumulatively added to thereby detect the magnitude of the applied thermal energy.

Here, the inventor performed a measurement such as shown in FIG. 3, in which the measurement of the temperature of the heating elements was performed again and again at constant time intervals after the start of heating of the minute heating members on the medium. The value "tx" of this temperature is obtained for each measurement and accumulated, and heating was continued until it reached a value of "s0" that was set as the target value. Then, a control was performed to stop the heating drive at the point when the accumulated value reached s0. At this point, it was confirmed that the color development density was always the same, regardless of the initial temperature.

This is also self-evident in the fact that the total generated heat energy s0 accompanying the temperature changes can be calculated as described below.

That is, if the specific heat capacity of the minute heating member is q and the temperature at a certain point in time is tx, then the generated heat energy Ex at that time is obtained as: Ex=q×tx.

Therefore, when the cycle at which the measurements are to be taken is set at a very short duration of time Td, then the total heat value s0 becomes the total cumulative value for the whole length of time, such that s0=ÓEx·Td=q33 Ótx·Td.

Here, Td is a constant, so s0=q·Td×Ótx, and then when K=q·Td, the total heat value s0 eventually becomes s0=K×Ótx.

From this formula it becomes evident that the total heat value s0 of heat applied onto the medium is proportional to the cumulative value of the temperatures being measured again and again at constant time intervals.

Accordingly, it can be understood that the values of the temperatures measured each time are to be added together until s0=K×Ótx, and the heating is to be continued until the multiplication of the product of the cumulative value by a proportionate constant k becomes equal to the target density value s0.

In other words, this means that the area below the temperature change curve in FIG. 3 is proportionate to the print density.

Here, the proportionate constant k is a constant determined in accordance with the voltage amplification factor of the temperature measurement result signal and the range of conversion by an analog/digital converter in a print control circuit described later.

According to the present invention, it is possible to calculate the generated heat energy using the above formula, and high-precision control of color development density can be performed in accordance with the energy/color density characteristics curve such as shown in FIG. 1 published by the paper manufacturers.

Figure 4:
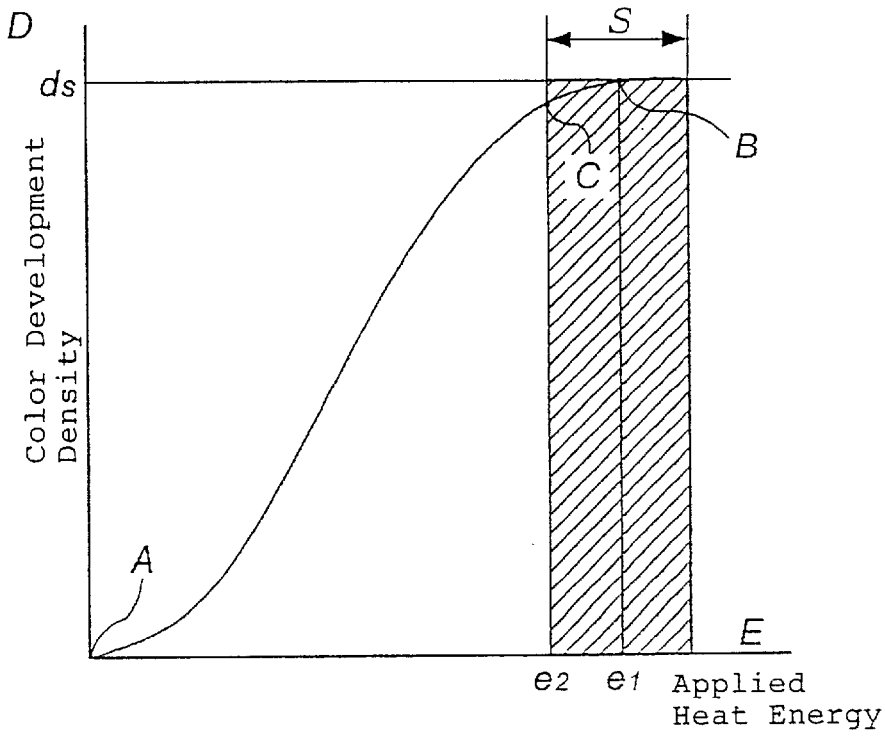
FIG. 4 is a chart for explaining increased energy conservation and increased printing speed realized by the present invention.

In the case of the conventional monochrome thermal color generation, when printing is to be executed in black and white, for example, as in FIG. 4, printing of the white is performed without heating, and so no heat energy is applied, as indicated by point "A". On the other hand, black is developed with the maximum color development density, and heat is increased until the energy value e1 is reached, which is deep into a saturated color development density region S, as indicated by point "B". This is set in the vicinity of the center region S, so that deviation from the saturated color development density region will not occur even in the case when a control error results in excess or insufficient amount of heat energy for developing the black color.

Compared to this, there are few such fluctuations in the control according to the present invention, so it is possible to stop the heating operation at the energy value e2 at the edge of the saturated color development density region S, for example, with a high level of accuracy. As a result, the difference of the energy value, i.e., e1–e2 becomes unnecessary, and thus energy conservation becomes possible. In the case of a printer using a battery for its power source, there is the advantage that the length of the intervals at which the batteries need to be exchanged thus becomes longer, and in the printing operation the printing can be completed earlier by an amount equivalent to the portion of the oblique line. Thus, high-speed printing becomes possible.

EXAMPLES

Figure 5:
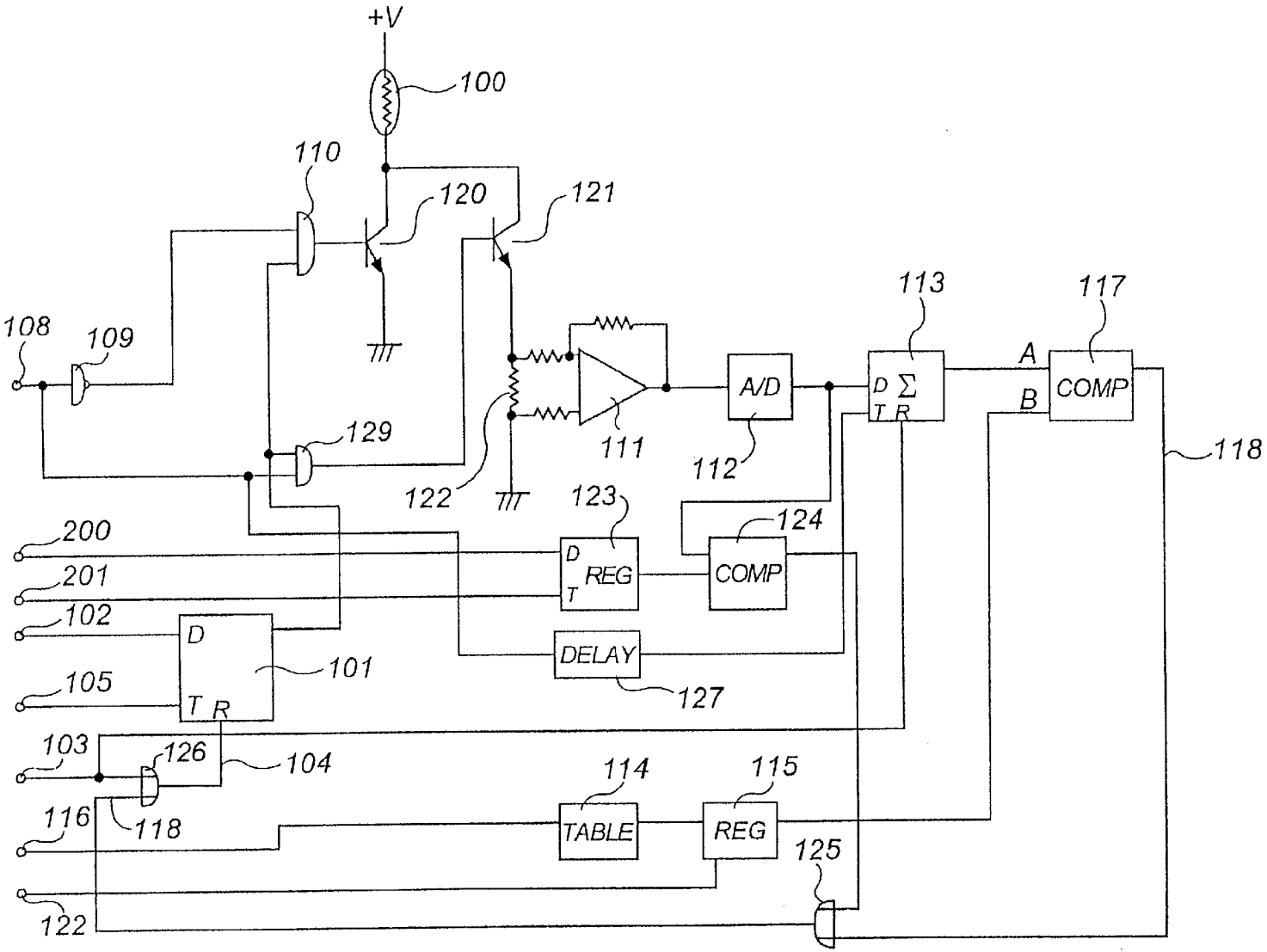
FIG. 5 is a circuit diagram showing one embodiment of the present invention.

Hereinafter, more detailed explanation will be made of an embodiment of the present invention. FIG. 5 is a diagram showing one embodiment of the present invention.

First, there are heating members which are aligned in an array on a thermal head, and which change their resistance values in accordance with the temperatures of the heat generated, and printing is effected when heating is started at each line all at once. If the thermal head has a dot pitch of, say, 300 dpi, then it is normal for the line pitch for the sub scanning, or simultaneous printing, to be performed at 300 dpi, too. The thermal printing onto the surface of the paper by the head is repeated cyclically at this pitch.

For the minute heating member 100 in FIG. 5 there is used a resistive member which is generally called a thermistor, and which changes the value of its resistance in accordance with the temperature of heat which has been generated. The metal composition of the thermistor ought to be selected from among compositions having a linear relationship between the changes in the temperature of the heating and the changes in the resistance value. One example of a composite which could be used would be an alloy of aluminum, chrome, boron and the like. Hereinafter, explanation will be made of operations of a circuit. A piece of data "1" from a device superior to a data register 101 that corresponds to a given element from among the minute heating members is written to an input terminal 102 according to a timing signal 105.

After that, when a signal "0" is inputted to the input terminal 108 from the superior device, an inverter 109 inverts the signal and the signal is inputted to an AND gate 110 as "1".

Into the other input terminal of the gate 110 there has been inputted the above-mentioned output signal 106 of the data register 101 as "1", so a logical product of the gate 110 can be produced, which makes a drive transistor 120 enter an ON state. Note that a transistor 121 is in an OFF state since the control signal 108 is "0" during the heat driving. As a result, an electric current flows to the heating member 100 and the transistor 120. As described above, when the heating member 100 receives the flow of the electric current it begins to produce heat energy and its resistance value changes. According to the present embodiment, an element is used in which the resistance value decreases when the temperature rises. As a result, as the temperature rises the value of the electric current flowing through the transistor 120 increases.

A means for detecting the status of the rise in the temperature of the heating element 100 will now be discussed. While the temperature is rising the transistor 120 is ON, which allows the electric current to flow therethrough. However, at the timing of temperature detection, the control signal 108 becomes "1" so that the transistor 120 turns to OFF, and another transistor 121 is switched from OFF to ON. As a result, the electric current flows to an electrical current detection resistor, which in this embodiment is a fixed resistor 122 having a fixed resistance value of about 70 Ohm.

As the heating element 100 produces heat and its temperature rises, its resistance value drops and the electrical current value increases. As a result of this, the electrical current flowing to the fixed resistor 122 increases and the voltage between the terminals of the resistor 122 rises. The output voltage of the resistor 122 is amplified by a linear amplifier circuit 111 and the amplified signal is then inputted to an analog/digital converter 112 of the next stage. As a result, the output value of the converter 112 is converted into a digital value expressed as having a bit number of about 8 bits as the temperature value of the heating member 108 of the head, and is then detected.

According to the embodiment, the detected data is cumulatively inputted continually into an adder 113 periodically at intervals of about 20 $\mu$ seconds and thus accumulated each time the measurement is performed after the heating begins. As a result, it becomes possible to detect the generated thermal energy value after the heating begins, by means of digital output of the adder 113. Hereinafter, the generated thermal energy value will be abbreviated as detected energy value "A". This "A" is proportionate to the s0=K·Ótx explained in the Operation section above. This detected value "A" is inputted to a greatness comparing circuit 117 so that it can be compared. Note that the adder 113 is cleared to zero by a set signal 103 before the print control is started for each line, and each time the signal 108 is switched from "0" to "1" during the print control for each line, the digital output of the analog/digital converter 112 is added to the adder 113 by a signal 128 which is slightly delayed by a delay circuit 127.

Meanwhile, at this point, designated value data regarding the print density with respect to the minute heating members which are being controlled is sent from the superior device to the input terminal 116 in a form of, say, 8-bit data for 256-gradation expression. This data is calculated in advance on the basis of the relationship between the density and the energy shown in FIG. 1, and the density data value is converted into an energy value by means of a generated data conversion table 114.

The conversion table for this purpose is constructed of a chart establishing correspondences between the density data values and the energy values. For example, in the case when a gradation indication being a numeric value 128 was sent from the superior device to the signal line 116, then this numeric value would be converted into an energy value of 2.56.

In other words, it is a conversion table produced with consideration of the color development properties of the paper being used such as shown, for example, in FIG. 1. In such a table, the print density is the input data, and the detected energy target value is the output data.

A conversion value of 2.56 in this data conversion table is stored in a register 115 during the printing control of the minute color generation portion in the printing, and it is inputted as a target energy control value "B" into the greatness comparing circuit 117 and compared against the above-mentioned detected value "A".

As long as the detected value "A" is less than the target value "B", the heating is continued because the control line 118 is "0". However, little by little, the cumulative energy value increases and the detected value "A" becomes greater than the object value "B", at which point the control line 118 for the output of the comparing circuit 117 changes from "0" to "1". As a result, outputs of logical addition gates 125 and 126 become "1". Accordingly, the register 101 is reset and the output of the logical product 110 becomes "0". Therefore, the drive transistor 120 turns OFF, the electric current stops flowing to the thermistor heating member 109 and the heating stops. That is, the energy was applied up to a predetermined density, so the heat generation drive stopped. This sort of heating operation is performed on all the minute heating members aligned in one array on the thermal head, the operation being performed with the above-mentioned control being performed independently and in a similar fashion. However, those heating members which are designated to develop color at low color development density are set with a small target value "B", so the heating operation for these naturally ends earlier than the heating operation for the heating members which are designated for darker color development.

Thereafter, even if the temperature detection signal 108 is inputted from the superior device, the signal 106 will be "0" since the register 101 has been reset. Therefore, the logical product gate 129 remains as it is at "0", which produces the result that the transistor 121 also turns OFF, so that the thermistor 100 will no longer be driven to generate heat.

As a protective means for preventing the thermal head from overheating and being damaged as a result when an operation failure occurs during the print operation, the following is performed: namely, at the time when the printing starts, a value of the highest possible temperature is sent from the superior device to an input terminal 200, set into the register 123 according to a setting timing 201, and compared by a comparator 124 against the output from the analog/digital converter 112. Then, in the case when the output value of the analog/digital converter 112 is greater than the value that was set into the register 123, the output is changed from "0" to "1", inputted via logical addition gates 125, 126 as a reset signal for the register 101 and the printing operation stops just as described above, which produces the result that irregular overheating is prevented and the reliability of the device is improved.

Figure 6:
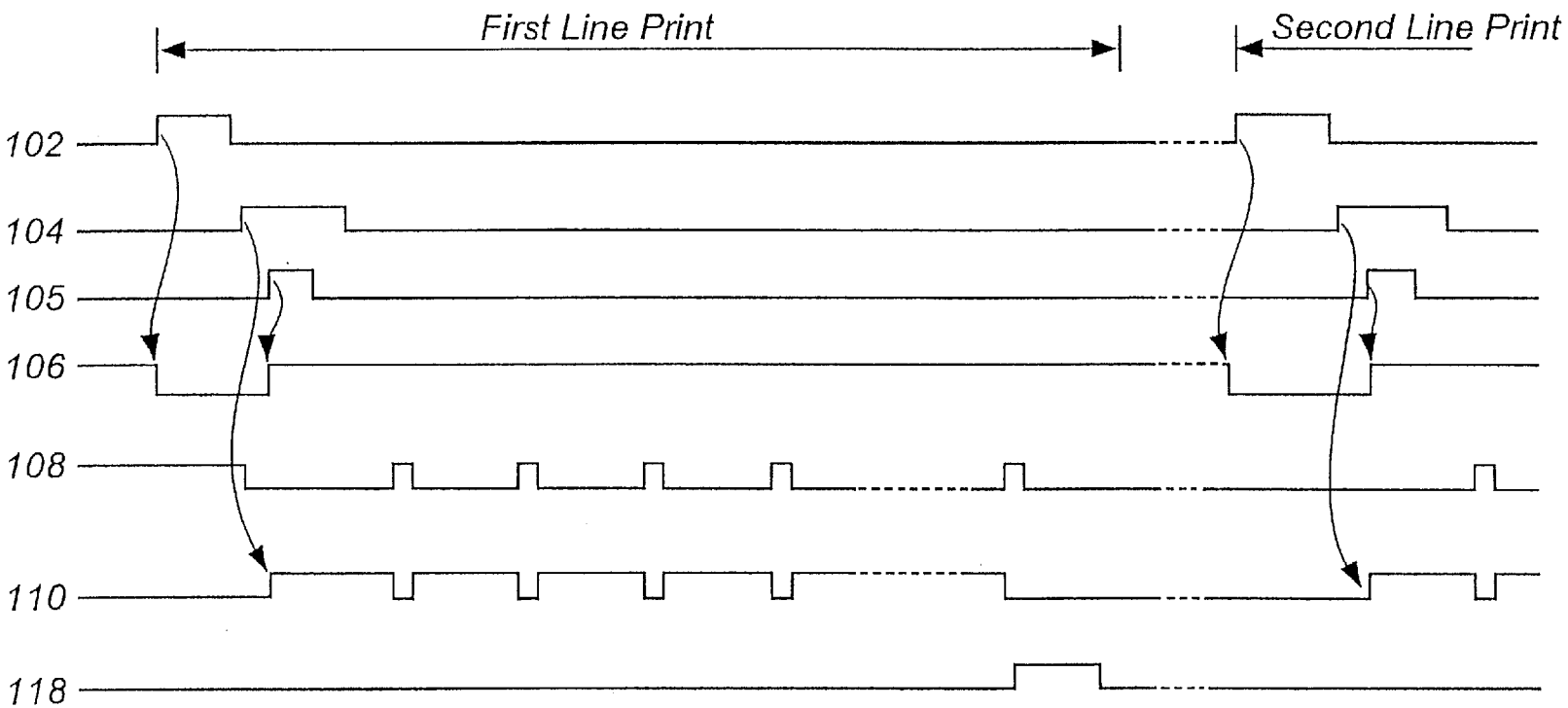
FIG. 6 is a timing flow chart diagram according to the embodiment.

If the heating of all the heating members has ended and the head position has moved by the distance of one pitch across the surface of the paper, then a subsequent color-development operation is started again all at once, and the operation described above is subsequently performed in repetition on the medium. A timing chart based on these explanations is written in FIG. 6.

In the case of monochrome thermo-sensitive recording paper, for example, the above-mentioned operations need to be performed for one color per sheet of the medium. However, in the case of three-color thermo-sensitive recording paper, heating controls according to three different types of color properties are performed a total of three times for each different energy region.

In either case, the cumulative value of thermal energy applied to each line of the surface are obtained again and again while detecting the surface temperatures, so extremely high-precision color-development management can be performed on the thermo-sensitive recording medium.

For example, 256-gradation multi-color-density printing to monochrome thermo-sensitive recording paper, which was very difficult to control in the prior art, becomes possible. Thus, printing with an image that is no different from photographic image quality can be performed at a high speed. Also, hologram film printing, which was conventionally possible only by a printing technique using a mold called a hot stamp, and demands heating at a high temperature region and within an extremely small temperature range, becomes possible. Also, printing methods employing free print patterns without using a fixed mold become possible.

What is claimed is:

1. A print control device comprising: a thermal head provided with a set of minute heating members, each serving as both a heating element and a temperature detector, and a drive circuit for supplying an electric current to drive said heating members; a control circuit for switching the electric current flowing to the respective heating members between a heating drive state and a temperature detection state; a circuit for converting temperature values from each of the heating members to voltage values and for detecting the voltage values, using electrical current that flows during the temperature detection state; an analog/digital conversion circuit for converting said voltage into a digital value; an adder for cumulatively adding digital values obtained by the digital conversion from the start of heating; a comparator for comparing the cumulative value obtained by said adder against a target print density value which is set in advance with respect to a given point on which printing is to be executed and is sent from a superior device, to thereby determine which one is greater; and a circuit for stopping the heating drive of said heating member if the comparator detects that the target print density has been reached.

2. The print control device according to claim 1, additionally comprising a circuit for temporarily stopping the heating drive when it is detected that a detected temperature has exceeded a pre-set value, before a target cumulative value is reached.

3. The print control device according to claim 2, additionally comprising a means for correcting the target cumulative value according to color development characteristics of a medium being used.

4. A method of printing with a print control device comprising the steps of:

providing a thermal head with a set of minute heating members, each of said minute heating members serving as both a heating element and a temperature detector;

supplying an electric current to drive the heating members;

switching the electric current supplied to the heating members between a heating drive state and a temperature detection state;

converting temperature values from each of the heating members to a voltage value;

determining the voltage value based on the electric current flowing during the temperature detection state;

converting the voltage value into a digital value;

adding the digital values to obtain a cumulative value;

comparing the cumulative value with a target print density value to determine which value is the greatest; and interrupting the supply of electric current to the heating members if the target print density value has been reached.

5. The method of claim 4, additionally comprising the step of stopping temporarily the electric current driving the heating members when a detected value has exceeded a pre-set value which is less than a target cumulative value.

6. The method of claim 5, additionally comprising the step of correcting the target cumulative value according to color development characteristics of a medium being used.

* * * * *